US009627807B2

(12) United States Patent
Gao et al.

(10) Patent No.: US 9,627,807 B2
(45) Date of Patent: Apr. 18, 2017

(54) REMOTE RADIO UNIT, AND CABLE CONNECTOR ASSEMBLY AND HOUSING OF THE SAME

(71) Applicant: SAMSUNG ELECTRONICS CO., LTD., Suwon-si (KR)

(72) Inventors: Fei Gao, Shenzen (CN); Guangxin Zhao, Shenzen (CN); Jinpei Ju, Shenzen (CN); Shengjun Ou, Shenzen (CN); Wensheng Chen, Shenzen (CN); Chunliang Chang, Shenzen (CN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 99 days.

(21) Appl. No.: 14/638,268

(22) Filed: Mar. 4, 2015

(65) Prior Publication Data

US 2015/0255921 A1 Sep. 10, 2015

(30) Foreign Application Priority Data

Mar. 4, 2014 (CN) ..... 2014 1 0076072

(51) Int. Cl.
*H01R 13/64* (2006.01)
*H01R 13/627* (2006.01)
*H01R 13/52* (2006.01)

(52) U.S. Cl.
CPC ..... *H01R 13/6273* (2013.01); *H01R 13/5202* (2013.01)

(58) Field of Classification Search
CPC ..... H01R 11/12; H01R 13/6275
USPC ..... 439/680, 677, 674, 357, 358
See application file for complete search history.

(56) References Cited

U.S. PATENT DOCUMENTS 4,998,896 A * 3/1991 Lundergan ..... H01R 13/443 439/274
5,775,931 A 7/1998 Jones
2011/0053437 A1 3/2011 De France

FOREIGN PATENT DOCUMENTS

WO 2012/113223 A1 8/2012

OTHER PUBLICATIONS

Communication dated Jul. 23, 2015 issued by the State Intellectual Property Office of the People's Republic of China in counterpart Chinese Patent Application No. 201410076072.4.
Communication dated Apr. 1, 2016 issued by the State Intellectual Property Office of the People's Republic of China in counterpart Chinese Patent Application No. 201410076072.4.

* cited by examiner

*Primary Examiner* — Phuongchi T Nguyen
(74) *Attorney, Agent, or Firm* — Sughrue Mion, PLLC

(57) ABSTRACT

A cable connector assembly includes a connecting frame, wherein an opening through which a cable penetrates is formed at an end of the connecting frame, a cable support connected to another end of the connecting frame and supporting the cable, a first locking part including a fixed end fixed to a first side of the connecting frame and a free end that is movable about the fixed end, a second locking part including a fixed end fixed to a second side of the connecting frame opposite to the first side of the connecting frame, and a free end that is movable about the fixed end, and a sealing portion surrounding the connecting frame and being elastic deformable.

14 Claims, 4 Drawing Sheets

REMOTE RADIO UNIT, AND CABLE CONNECTOR ASSEMBLY AND HOUSING OF THE SAME

RELATED APPLICATION

This application claims the benefit of Chinese Patent Application No. 201410076072.4, filed on Mar. 4, 2014, in the State Intellectual Property Office of the P.R.C., the disclosure of which is incorporated herein in its entirety by reference.

BACKGROUND

1. Field

One or more exemplary embodiments relate to a remote communication device, and more particularly, to a remote radio unit and a cable connector assembly and housing.

2. Description of the Related Art

A remote radio unit may include an external port for transmitting signals and supplying power. Since the remote radio unit is generally operated under a hostile environment, maintenance for the external port may be performed regularly to prevent dust or rainwater from entering the remote radio unit. In addition, the external port has various types and a large amount, requires a plug operation that frequently occurs to connect the external port with antennas, power supplies, and data optical fibers, and has a compact structure, a small volume, and a poor mounting space. Therefore, the external port of the remote radio unit is recommended to have features such as a convenient and fast plug operation, a compact structure, reliable protection, and low production cost.

Accordingly, in the remote radio unit, the external port is mounted on a mounting panel by using a flange defined sealing rings and fixed screws so that a cable and an inner portion of the remote radio unit are connected. However, the above structure may require an excessive amount of components, consume a large amount of materials, and have high machining difficulty and cost. Also, using the flange may have drawbacks such as occupying a large space and complicated operations.

SUMMARY

One or more exemplary embodiments include a remote radio unit having a compact structure, a convenient operation and an improvement of a sealing function, and a cable connector assembly and housing of the remote radio unit.

Additional aspects will be set forth in part in the description which follows and, in part, will be apparent from the description, or may be learned by practice of the presented exemplary embodiments.

According to one or more exemplary embodiments, a cable connector assembly includes a connecting frame, wherein an opening through which a cable penetrates is formed at an end of the connecting frame, a cable support connected to another end of the connecting frame and supporting the cable, a first locking part including a fixed end fixed to a first side of the connecting frame, and a free end that is movable about the fixed end, a second locking part including a fixed end fixed to a second side of the connecting frame opposite to the first side of the connecting frame, and a free end that is movable about the fixed end, and a sealing portion surrounding the connecting frame and being elastic deformable.

Each of the respective free ends of the first and second locking parts may have an inclination surface that forms a predetermined angle with the connecting frame.

The respective free ends of the first and second locking parts may be disposed toward the end of the connecting frame.

Each of the first and second locking parts may include at least one opening.

The cable support may be elastic deformable, may surround a periphery of the cable, and may support the cable such that the cable is movable.

The cable support may be shaped as a bellows.

The cable support and the sealing portion may be integrally formed.

An uneven structure may be formed at an outer peripheral surface of the sealing portion.

A cross-section of the connecting frame may be rectangular.

The end of the connecting frame may be smaller than the other end of the connecting frame.

The cable connector assembly may further include a position block fixed to the cable, and a position sleeve disposed in the connecting frame and limits movement of the position block.

According to one or more exemplary embodiments, a remote radio unit includes a cable connector including a connecting frame, wherein an opening through which a cable penetrates is formed at an end of the connecting frame, a cable support connected to another end of the connecting frame and supporting the cable, a first locking part including a fixed end fixed to a first side of the connecting frame and a free end that is movable about the fixed end, a second locking part including a fixed end fixed to a second side of the connecting frame opposite to the first side of the connecting frame and a free end that is movable about the fixed end, and a sealing portion surrounding the connecting frame and elastic deformable; and a housing including a body, at least one insertion hole formed in the body such that the connecting frame of the cable connector assembly is inserted, and first and second coupling units formed in the body such that the first and second coupling units are separated from both sides of the at least one insertion hole of the body and coupled to the first and second locking parts of the cable connector assembly.

Each of the first and second coupling portions may have protrusions that are inserted into the respective openings of the first and second locking parts.

According to one or more exemplary embodiments, a housing of a remote radio unit includes a body, at least one insertion hole formed in the body such that a portion of a cable connector assembly is inserted, and first and second coupling units separately provided at both sides of the at least one insertion hole of the body and fixing the cable connector assembly. The cable connector assembly includes a connecting frame, wherein an opening through which a cable penetrates is formed at an end of the connecting frame, a cable support connected to another end of the connecting frame and supporting the cable, a first locking part including a fixed end fixed to a first side of the connecting frame and a free end that is movable about the fixed end, a second locking part including a fixed end fixed to a second side of the connecting frame opposite to the first side of the connecting frame and a free end that is movable about the fixed end, and a sealing portion surrounding the connecting frame and being elastic deformable.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
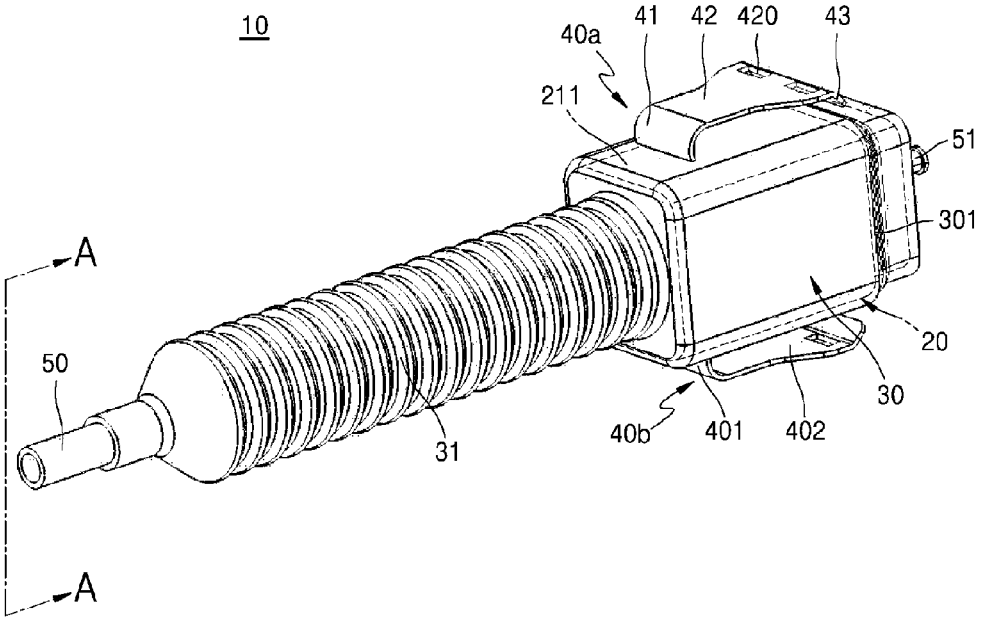
FIG. 1 is a perspective view illustrating a cable connector assembly according to an exemplary embodiment.

Hereinafter, features and functions of a remote radio unit and a cable connector assembly and housing of the remote radio unit will be described in detail with reference to exemplary embodiments, examples of which are illustrated in the accompanying drawings. The exemplary embodiments should not be construed as being limited to the descriptions set forth herein, and are provided to fully describe the present inventive concept to one of ordinary skill in the art. In the drawings, like reference numerals refer to like elements throughout and sizes or thicknesses of components may be exaggerated for clarity of description. Expressions such as "at least one of," when preceding a list of elements, modify the entire list of elements and do not modify the individual elements of the list.

Figure 2:
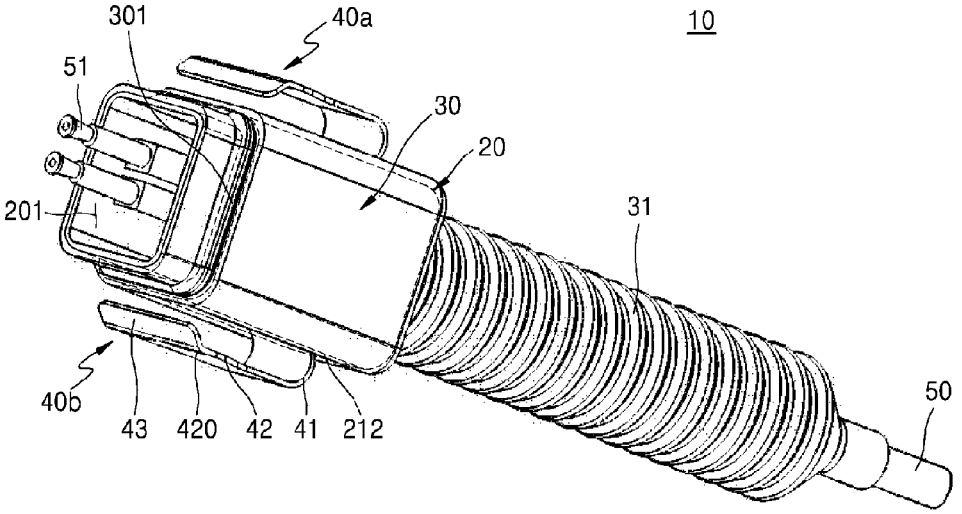
FIG. 2 is a perspective view illustrating a cable connector assembly from a different angle, according to an exemplary embodiment.
Figure 3:
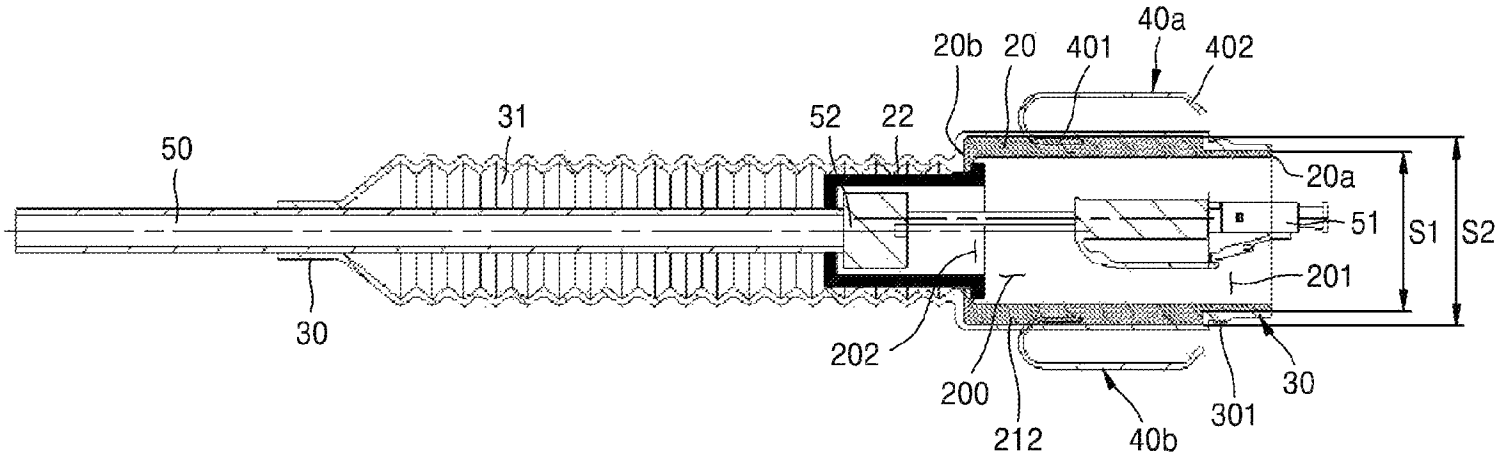
FIG. 3 is a cross-sectional view of a cable connector assembly cut along A-A direction of FIG. 1.

FIG. 1 is a perspective view illustrating a cable connector assembly 10 according to an exemplary embodiment. FIG. 2 is a perspective view illustrating the cable connector assembly 10 from a different angle, according to an exemplary embodiment. FIG. 3 is a cross-sectional view of the cable connector assembly cut along A-A direction of FIG. 1.

Referring to FIGS. 1 to 3, the cable connector assembly 10 includes a connecting frame 20, a cable support 31, first and second locking parts 40*a* and 40*b*, and a sealing portion 30.

The connecting frame 20 includes a through hole 200. An opening 201 is formed at an end 20*a* of the connecting frame 20 and an opening 202 is formed at another end 20*b* of the connecting frame 20. A cable 50 may penetrate through the through hole 200, the openings 201 and 202.

The connecting frame 20 may be formed of high strength plastic or other materials that are not easily deformed to ensure that the cable connector assembly 10 is not modified.

A width and height of the connecting frame 20 may be different. For example, a cross-section of the connecting frame 20 may be rectangular, but is not limited thereto. The cross-section of the connecting frame 20 may be polygonal, circular, or oval.

In the connecting frame 20, a size S1 of the end 20*a* may be smaller than a size S2 of the other end 20*b*.

The cable support 31 may be connected to the other end 20*b* of the connecting frame 20. The cable 50 may be disposed such that the cable 50 penetrates through the connecting frame 20 and the cable support 31. The cable support 31 may support the cable 50.

The cable support 31 may be expanded, contracted, or bent by a user. For example, the cable support 31 may be formed of rubber or similar materials, for example, polyphenylene ether (PPE). Also, the cable support 31 may be shaped as a bellows of which outer appearance has wrinkles.

In the connecting frame 20, the first locking part 40*a* may be formed in a first side 211, and the second locking part 40*b* may be formed in a second side 212 that is facing the first side 211.

The first locking part 40*a* may include a fixed end 401 that is fixed to the first side 211 of the connecting frame 20, and a free end 402 that is movable about the fixed end 401. The second locking part 40*b* may include a fixed end 401 that is fixed to the second side 212 of the connecting frame 20, and a free end 402 that is movable about the fixed end 401.

Each of the first and second locking parts 40*a* and 40*b* may include at least one opening 420. For example, two openings 420 may be formed in the first locking part 40*a* and two openings 420 may be formed in the second locking part 40*b*. However, the number of openings 420 formed in the first and second locking parts 40*a* and 40*b* is not limited thereto. For example, one opening 420 or three or more openings 420 may be formed in the first and second locking parts 40*a* and 40*b*. Also, the number of openings 420 in the first locking part 40*a* may be the same or different from the number of openings 420 in the second locking part 40*b*.

The free ends 402 of the first and second locking parts 40*a* and 40*b* may be disposed toward the end 20*a* of the connecting frame 20. For example, the end 20*a* of the connecting frame 20 may be closer to the free end 402 than the fixed end 401.

The free end 402 of the first locking part 40*a* may have an inclination surface that forms a predetermined inclination angle with the first side 211 of the connecting frame 20. The free end 402 of the second locking part 40*b* may have an inclination surface that forms a predetermined inclination angle with the second side 212 of the connecting frame 20. The inclination angle may be an acute or an obtuse angle.

Each of the first and second locking parts 40*a* and 40*b* may include a bending portion 41, an extending portion 42, and a guiding portion 43.

The bending portion 41 may be fixed to the first side 211 or the second side 212 of the connecting frame 20. The extending portion 42 may extend from the bending portion 41. At least a portion of the extending portion 42 may be substantially parallel to the first side 211 or the second side 212. An end of the guiding portion 43 may be connected to the extending portion 42 and the other end of the guiding portion 43 may incline and form a predetermined inclination angle with the connecting frame 20.

The opening 420 may be defined on or formed in the extending portion 42. However, a location of the opening 420 is not limited thereto. The opening 420 may be defined on or formed in the guiding portion 43.

The cable 50 may penetrate through the connecting frame 20 and the cable support 31, fixed to an end of the cable support 31 away from the connecting frame 20, and sealed by the cable support 31.

A joint 51 may be disposed at an end of cable 50. The joint 51 may be disposed at a terminal of the cable 50 which is used to connect the cable 50 with a circuit board plug (not shown) disposed in a housing (70 of FIGS. 4 to 6) of a remote radio unit (1 of FIGS. 4 to 6).

The sealing portion 30 may surround the connecting frame 20. For example, the sealing portion 30 may cover a perimeter of the connecting frame 20. The sealing portion 30 may be formed of an elastic deformable material. For example, the sealing portion 30 may be formed of rubber or a material similar to rubber. The sealing portion 30 may be tightly inserted into an insertion hole (701 of FIGS. 4 to 6) of the housing (70 of FIGS. 4 to 6) which will be described below.

Also, an uneven structure 301 may be formed in a portion of the sealing portion 30 to which the housing 70 is connected. The uneven structure 301 may be referred to as a seal lip. The uneven structure 301 may have a cross-section that facilitates the insertion of the housing 70. For example, the cross-section of the uneven structure 301 may be shaped as serrations. A portion of the cross-section of the uneven structure 301 near the opening 201 located at the end 20*a* of the connecting frame 20 may more gradually incline than a portion of the cross-section of the uneven structure 301 away from the opening 201. When the cable connector assembly 10 is coupled to the housing 70, the uneven structure 301 may improve sealing performance so that the remote radio unit is dustproof and waterproof. For example, because of the sealing portion 30 including the uneven structure 301, a degree of resistance to dust and water of the remote radio unit may be Ingress Protection (IP) 67 rating.

A position block 52 is fixed to the cable 50. A position sleeve 22 is disposed in the connecting frame 20 and limits movement of the position block 52. The cable 50 is movable relative to the connecting frame 20. When the cable 50 is pulled by an external force to move the cable 50, the position sleeve 22 may limit movement of the position block 52. For example, the position block 52 fixed to the cable 50 is movable with movement of the cable 50 before the position block 52 contacts the position sleeve 22. However, once the position block 52 contacts the position sleeve 22, the position block 52 may not be moved even when the external force is applied to the cable 50. Therefore, even when the external force is applied to the cable 50, the joint 51 provided at an end of the cable 50 may be less affected by the external force.

The connecting frame 20, the sealing portion 30, and the first and second locking parts 40*a* and 40*b* may be formed as an all-in-one component so that a position relationship between the connecting frame 20, the sealing portion 30, and the fixed ends 401 of the first and second locking parts 40*a* and 40*b* are fixed in the cable connector assembly 10.

For example, the cable connector assembly 10 may be manufactured as an all-in-one component by performing a first insert injection process of disposing the first and second locking parts 40*a* and 40*b* on the connecting frame 20 and a second insert injection process of surrounding the sealing portion 30 around the connecting frame 20. According to the simple structure and manufacturing method as described above, the production cost of the cable connector assembly 10 may be reduced. For example, the cable connector assembly 10 according to an exemplary embodiment may be manufactured with about 7% to 10% of the production cost of a general cable assembly.

Figure 4:
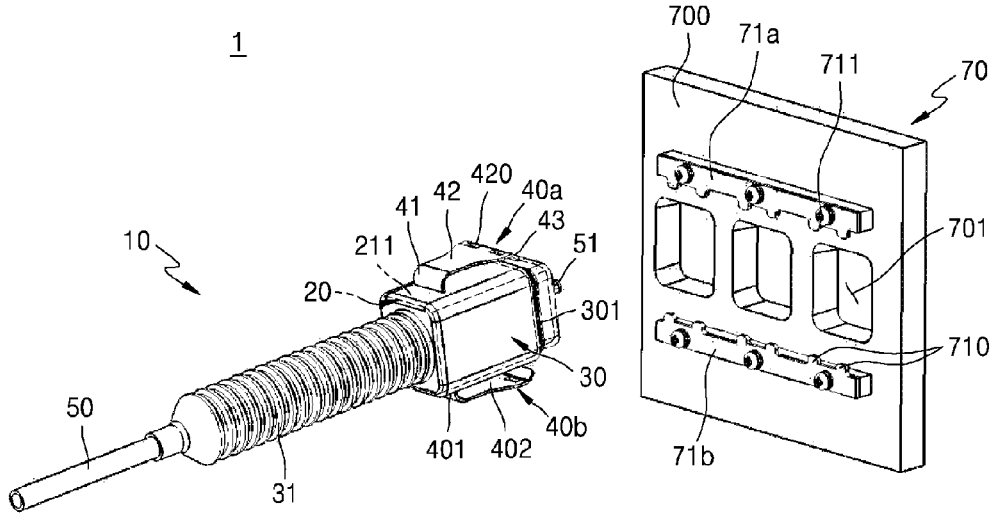
FIG. 4 is a perspective view schematically illustrating a state before a cable connector assembly is mounted on a housing of a remote radio unit.
Figure 5:
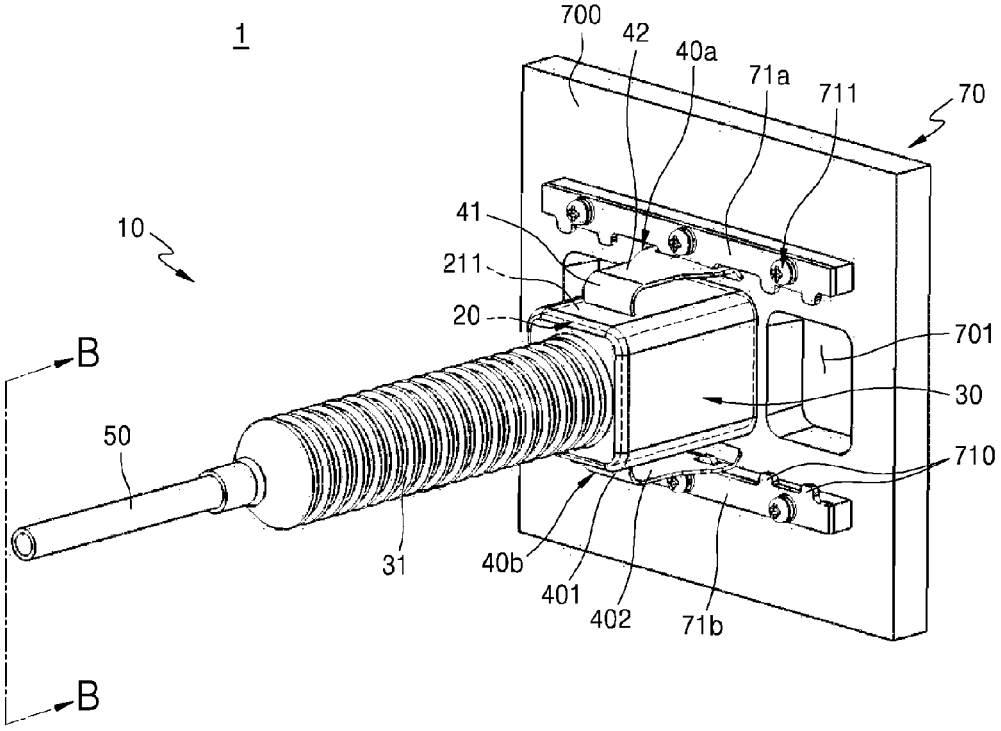
FIG. 5 is a perspective view schematically illustrating a state after a cable connector assembly is mounted on a housing of a remote radio unit.
Figure 6:
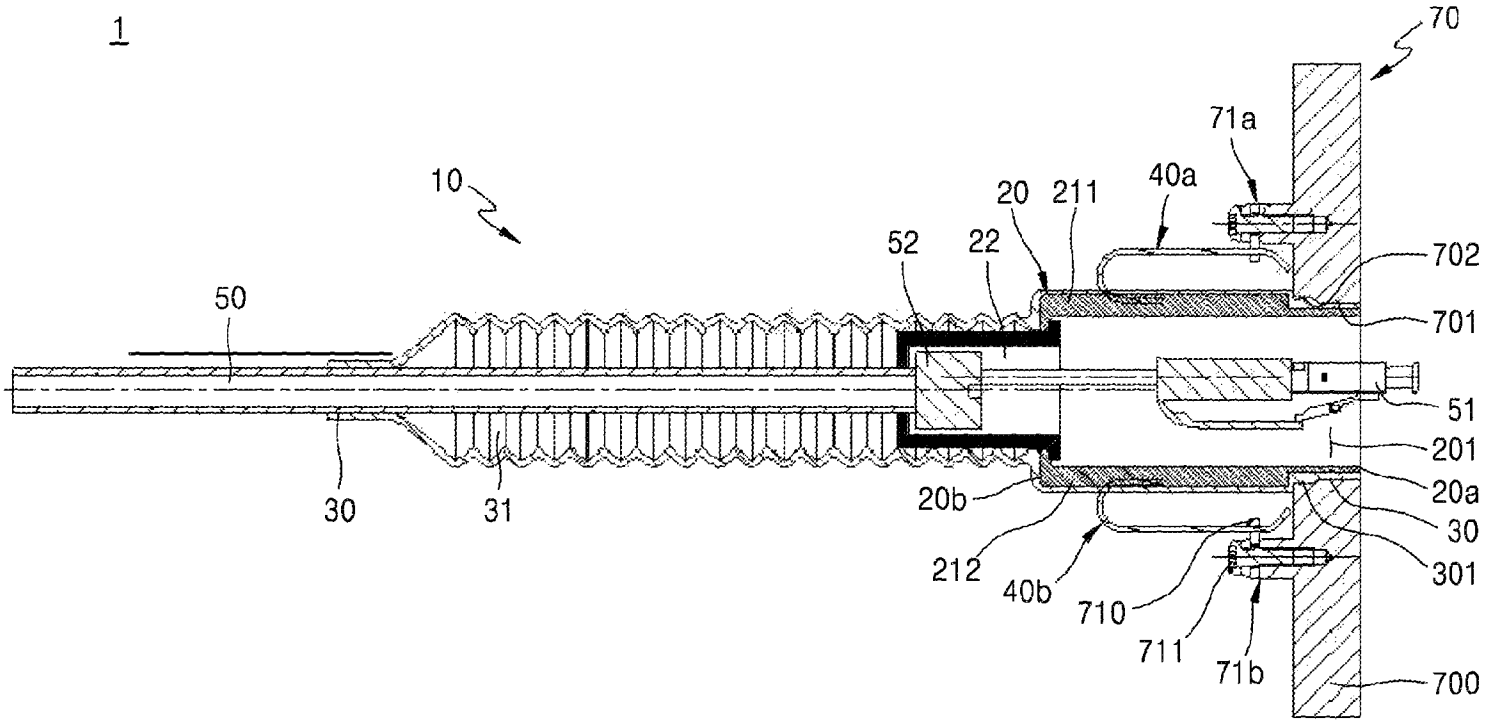
FIG. 6 is a cross-sectional view of a cable connector assembly cut along B-B direction.

FIG. 4 is a perspective view schematically illustrating a state before the cable connector assembly 10 is mounted on a housing 70 of a remote radio unit 1. FIG. 5 is a perspective view schematically illustrating a state after the cable connector assembly 10 is mounted on the housing 70 of the remote radio unit 1. FIG. 6 is a cross-sectional view of the cable connector assembly 10 cut along B-B direction.

Referring to FIGS. 4 to 6, the remote radio unit 1 includes the cable connector assembly 10 and the housing 70. Since the cable connector assembly 10 is the same as the exemplary embodiment described above, the cable connector assembly 10 will not be repeatedly described.

The housing 70 may include a body 700, at least one insertion hole 701 formed in the body 700, and first and second coupling units 71*a* and 71*b* in the body 700. The first and second coupling units 71*a* and 71*b* respectively are separated from both sides of the insertion holes 701 in the body 700.

The insertion holes 701 are provided to insert the connecting frame 20. Each of the first and second coupling units 71*a* and 71*b* may include at least one protrusion 710. The protrusions 710 are coupled to the opening 420 of the first and second locking parts 40*a* and 40*b*. The first and second coupling units 71*a* and 71*b* including the protrusions 710 may be manufactured by punching or cutting. The first and second coupling units 71*a* and 71*b* may be assembled in the body 700 of the housing 70 such that the first and second coupling units 71*a* and 71*b* are separately from both sides of the insertion holes 701. Bolts 711 may be used to mount the first and second coupling units 71*a* and 71*b* onto the body 700.

The first and second coupling units 71*a* and 71*b* may be formed of stainless steel. However, a material of the first and second coupling units 71*a* and 71*b* is not limited thereto. The first and second coupling units 71*a* and 71*b* may be formed of plastic or other materials with sufficient strength.

In order to save space, the insertion holes 701 are disposed side by side on the housing 70. By disposing the insertion holes 701 side by side, the manufacturing cost may be reduced and the cable connector assembly 10 may be easily mounted on the insertion holes 701. Although FIGS. 4 and 5 illustrate that the first and second coupling units 71*a* and 71*b* are respectively disposed above and under the insertion holes 701, exemplary embodiments are not limited thereto. For example, when the insertion holes 701 are arranged in a longitudinal direction, the first and second coupling units 71*a* and 71*b* may be disposed at left and right sides of the insertion holes 701.

Hereinafter, mounting and separation processes of the remote radio unit 1 according to an exemplary embodiment will be described.

First, a process of mounting the cable connector assembly 10 to the housing 70 of the remote radio unit 1 will be described.

In order to mount the cable connector assembly 10, pressure is applied to the cable support 31, which is shaped as a bellows, such that the cable support 31 contracted. In this case, a portion of the cable 50 is supported and sealed by the cable support 31. When the cable support 31 is contracted, the joint 51 of the cable 50 may protrude by a predetermined distance from the opening 201 formed in the end 20*a* of the connecting frame 20. A protruding portion of the joint 51 may be inserted into one of the insertion holes 701 of the housing 70 and connected to a corresponding internal print circuit board (PCB).

Next, the end 20*a* of the connecting frame 20 is inserted into the one of the insertion holes 701 of the housing 70. The end 20*a* of the connecting frame 20 may be smaller than the other end 20*b* of the connecting frame 20. Accordingly, the end 20*a* of the connecting frame 20 may be inserted into the one of the insertion holes 701, and a portion around the one of the insertion holes 701 may be covered by the other end 20*b* of the connecting frame 20.

During the process of inserting the end 20*a* of the connecting frame 20 into one of the insertion holes 701 of the housing 70, pressure may be applied to the first and second locking parts 40*a* and 40*b* disposed at both sides of the connecting frame 20 such that the protrusions 710 of the first and second coupling units 71*a* and 71*b* of the housing 70 are inserted in to the openings 420 of the first and second locking parts 40*a* and 40*b*. As a result, the cable connector assembly 10 is mounted on and fixed to the housing 70. Since the cross-section of the connecting frame 20 may be rectangular, the user may accurately insert the connecting frame 20 into one of the insertion holes 701 such that the first and second locking parts 40*a* and 40*b* respectively face the first and second coupling units 71*a* and 71*b*.

When the cable connector assembly 10 is mounted on and fixed to the housing 70, the sealing portion 30 that surrounds the connecting frame 20 has elastic deformed by the insertion holes 701 of the housing 70. That is, the connecting frame 20 and the insertion holes 701 are sealed by the sealing portion 30. In addition, the connecting frame 20 and the insertion holes 701 may be more firmly sealed by the uneven structure 301 formed at an outer peripheral surface of the sealing portion 30. In order to additionally improve the sealing function, an uneven structure 702 that has a shape corresponding to that of the uneven structure 301 may be defined on inner surfaces of the insertion holes 701 of the housing 70. A degree of resistance to dust and water of the remote radio unit according to an exemplary embodiment may be IP67 rating.

Also, since the cable connector assembly 10 includes the position sleeve 22 and the position block 52, movement of the cable 50 may be limited even when external force is applied to the cable 50. For example, the position block 52 fixed to the cable 50 is movable before the position block 52 contacts the position sleeve 22. However, once the position block 52 contacts the position sleeve 22, the position block 52 may not be moved even when the external force is applied to the cable 50. The external force applied to the cable 50 is transmitted to the position sleeve 22 via the position block 52, and the external force transmitted to the position sleeve 22 may be sequentially transmitted to the connecting frame 20, the first and second locking parts 40*a* and 40*b*, and then the housing 70. Therefore, even when the external force is suddenly applied to the cable 50, a connection between the joint 51 provided at an end of the cable 50 and a PCB plug in the housing 70 is not affected by the external force, and thus, a stable connection may be maintained.

Next, a process of separating the cable connector assembly 10 from the housing 70 of the remote radio unit 1 will be described.

In order to separate the cable connector assembly 10 from the housing 70 of the remote radio unit 1, first, pressure is applied to the first and second locking parts 40*a* and 40*b* and the cable connector assembly 10 is pulled in a direction opposite to a mounted direction so that the openings 420 of the first and second locking parts 40*a* and 40*b* are disconnected from the protrusions 710 of the first and second coupling units 71*a* and 71*b*.

In addition, the cable support 31 is compressed such that a sufficient length of the joint 51 of the cable 50 is revealed.

Next, stick a finger into the insertion holes 701 of the housing 70 and separate the joint 51 of the cable 50 from an internal PCB.

As described above, the cable connector assembly 10 may be coupled to or separated from the housing 70 by the first and second locking parts 40*a* and 40*b*. Therefore, the cable connector assembly 10 may be quickly and conveniently connected to and disconnected from the housing 70 of the remote radio unit 1.

Also, since coupling and separation processes may be performed by using the first and second locking parts 40*a* and 40*b* respectively disposed at the first and second sides 211 and 212 of the connecting frame 20, a space for coupling the cable connector assembly 10 to the housing 70 may be reduced. For example, the cable connector assembly 10 may be coupled to the housing 70 by using about 60% to 70% of a space required for coupling and separating the cable connector assembly 10 by using four sides. Therefore, more than one cable connector assembly 10 may be coupled to and separated in a small space in the housing 70. For example, a distance between two adjacent cable connector assemblies 10 may be reduced to 28 mm or less.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A cable connector assembly comprising:

a connecting frame, wherein an opening through which a cable penetrates is formed at an end of the connecting frame;

a cable support connected to another end of the connecting frame and supporting the cable;

a first locking part comprising a fixed end fixed to a first side of the connecting frame, and a free end that is movable about the fixed end;

a second locking part comprising a fixed end fixed to a second side of the connecting frame opposite to the first side of the connecting frame, and a free end that is movable about the fixed end; and a sealing portion surrounding the connecting frame and being elastic deformable, wherein each of the first and second locking parts comprises a first portion which is protruded from one of the first and second sides, and a second portion which extends from the first portion and is disposed to face one of the first and second sides, on an outside of the sealing portion.

2. The cable connector assembly of claim 1, wherein each of the first and second locking parts further comprises a third portion which extends from the second portion and forms a predetermined angle with the connecting frame.

3. The cable connector assembly of claim 1, wherein the respective free ends of the first and second locking parts are disposed toward the end of the connecting frame.

4. The cable connector assembly of claim 1, wherein each of the first and second locking parts comprises at least one opening.

5. The cable connector assembly of claim 1, wherein an uneven structure is formed at an outer peripheral surface of the sealing portion.

6. The cable connector assembly of claim 1, wherein a cross-section of the connecting frame is rectangular.

7. The cable connector assembly of claim 1, wherein the end of the connecting frame is smaller than the other end of the connecting frame.

8. The cable connector assembly of claim 1, wherein the cable is movable relative to the connecting frame, and wherein the cable connector assembly further comprises:

a position block fixed to the cable and movable with movement of the cable; and a position sleeve disposed in the connecting frame and limits movement of the position block to limit movement of the cable.

9. The cable connector assembly of claim 1, wherein the cable support is elastic deformable, surrounds a periphery of the cable, and supports the cable such that the cable is movable.

10. The cable connector assembly of claim 9, wherein the cable support is shaped as a bellows.

11. The cable connector assembly of claim 9, wherein the cable support and the sealing portion are integrally formed.

12. A remote radio unit comprising:

a cable connector comprising a connecting frame, wherein an opening through which a cable penetrates is formed at an end of the connecting frame, a cable support connected to another end of the connecting frame and supporting the cable, a first locking part comprising a fixed end fixed to a first side of the connecting frame and a free end that is movable about the fixed end, a second locking part comprising a fixed end fixed to a second side of the connecting frame opposite to the first side of the connecting frame and a free end that is movable about the fixed end, and a sealing portion surrounding the connecting frame and elastic deformable; and a housing comprising a body, at least one insertion hole formed in the body such that the connecting frame of the cable connector assembly is inserted, and first and second coupling units formed in the body such that the first and second coupling units are separated from both sides of the at least one insertion hole of the body and coupled to the first and second locking parts of the cable connector assembly.

13. The remote radio unit of claim 12, wherein each of the first and second coupling portions has protrusions that are inserted into the respective openings of the first and second locking parts.

14. A housing of a remote radio unit, the housing comprising:

a body;

at least one insertion hole formed in the body such that a portion of a cable connector assembly is inserted; and first and second coupling units separately provided at both sides of the at least one insertion hole of the body and fixing the cable connector assembly, wherein the cable connector assembly comprises:

a connecting frame, wherein an opening through which a cable penetrates is formed at an end of the connecting frame;

a cable support connected to another end of the connecting frame and supporting the cable;

a first locking part comprising a fixed end fixed to a first side of the connecting frame, and a free end that is movable about the fixed end;

a second locking part comprising a fixed end fixed to a second side of the connecting frame opposite to the first side of the connecting frame, and a free end that is movable about the fixed end; and a sealing portion surrounding the connecting frame and being elastic deformable.

* * * * *